United States Patent [19]

Radermacher

[11] Patent Number: 4,724,679

[45] Date of Patent: Feb. 16, 1988

[54] ADVANCED VAPOR COMPRESSION HEAT PUMP CYCLE UTILIZING NON-AZEOTROPIC WORKING FLUID MIXTURES

[76] Inventor: Reinhard Radermacher, 5108 Flanders Ave., Kensington, Md. 20895

[21] Appl. No.: 881,286

[22] Filed: Jul. 2, 1986

[51] Int. Cl.[4] ..... F25B 15/00

[52] U.S. Cl. ..... 62/101; 62/114

[58] Field of Search ..... 62/114, 101

[56] References Cited

U.S. PATENT DOCUMENTS

| | | | |
|---|---|---|---|
| Re. 30,252 | 4/1980 | Leonard | 62/84 |
| 2,781,644 | 2/1957 | Saposnikov et al. | 62/101 |
| 3,312,078 | 4/1967 | Aerov et al. | 62/114 X |
| 3,922,873 | 12/1975 | Leonard | 62/101 X |
| 3,990,264 | 11/1976 | Patnode et al. | 62/476 |
| 4,179,898 | 12/1979 | Vakil | 62/114 |
| 4,311,019 | 1/1982 | Rojey et al. | 62/114 X |
| 4,406,135 | 9/1983 | Rojey et al. | 62/114 |
| 4,420,946 | 12/1983 | Rojey et al. | 62/101 |
| 4,442,677 | 4/1984 | Kauffman | 60/673 |
| 4,531,374 | 7/1985 | Alefeld | 62/79 |
| 4,598,556 | 7/1986 | Mokadam | 62/117 |

FOREIGN PATENT DOCUMENTS

| | | |
|---|---|---|
| 84084 | 2/1895 | Fed. Rep. of Germany . |
| 278076 | 8/1911 | Fed. Rep. of Germany . |
| 386863 | 6/1920 | Fed. Rep. of Germany . |
| 953378 | 5/1956 | Fed. Rep. of Germany . |
| 1125956 | 3/1962 | Fed. Rep. of Germany . |
| 537438 | 5/1922 | France . |

*Primary Examiner*—Lloyd L. King

*Attorney, Agent, or Firm*—Murray and Whisenhunt

[57] ABSTRACT

A process for transferring heat from a lower temperature material to a higher temperature material utilizes a non-azeotropic working fluid mixture and overlapping temperatures in the evaporator (desorber) and condenser (absorber). An apparatus for effectuating the process thermally couples the evaporator (desorber) and condenser (absorber).

29 Claims, 6 Drawing Figures

ADVANCED VAPOR COMPRESSION HEAT PUMP CYCLE UTILIZING NON-AZEOTROPIC WORKING FLUID MIXTURES

BACKGROUND OF THE INVENTION

1. Field of the Invention

The present invention is directed to a vapor compression heat pump cycle which permits adjustment of the heat pump capacity over a wide range independently from outdoor conditions. More particularly, the present invention is directed to a method of transferring heat by a vapor compression heat pump cycle and an apparatus therefor, whereby a low pressure ratio for the compressor can be maintained.

2. Description of the Prior Art

*German Pat. No.* 84,084 discloses a method of refrigeration wherein a supersaturated ammonia solution is passed into an evaporator chamber, which is held at a lower pressure (higher than atmospheric), and a portion of the ammonia evaporates to produce a cooling effect. The so-formed gaseous ammonia is transferred with the weaker, but still supersaturated, ammonia solution to a chamber maintained at a higher pressure where the ammonia is reabsorbed, while being cooled. The reconstituted supersaturated ammonia solution is then once again fed into the evaporator.

*French Pat. No.* 537,438 discloses a refrigeration technique wherein a normally gaseous material (e.g., ammonia) is evaporated from a solution (e.g., an aqueous solution) in contact with coils containing a circulating fluid to cool the circulating fluid, in a desorber. The gaseous material is then pumped to an adsorber where it is contacted with the depleted aqueous solution, under pressure, so as to be readsorbed to reconstitute the aqueous solution. The adsorber is cooled by a cooling coil with a flow of cooling water therethrough. The reconstituted solution is further cooled by indirect countercurrent heat exchange with the depleted aqueous solution exiting the desorber before entering the desorber.

*German Pat. No.* 386863 discloses a heat transfer system wherein heat is transferred from a lower temperature body to a higher temperature body by use of two combined refrigeration cycles wherein one of the cycles is of the compression type and the other cycle is of the absorption type. For instance, the heat of flowing water at a temperature of 15°–29° C. is used to ultimately generate steam at two atmospheres pressure. In particular, a compressor compresses ammonia gas from 6 to 30 atm. (which would correspond to a condensation temperature of 66° C.). The compressed ammonia is delivered into a first tank which contains an aqueous ammonia solution with 40% ammonia. This solution absorbs the compressed ammonia at a temperature of 130° C. The heat released at this temperature is given off to a water tank which generates the steam at two atmospheres pressure. In order to replace the now-enriched solution in the first tank by a weaker solution, a second tank, from which the compressor obtains the ammonia gas is likewise filled with a 40% ammonia solution. From this solution is formed, under a pressure of 6 atmospheres, the ammonia gas at a temperature of 60° C. The required heat of evaporation of the ammonia is supplied by the second cyclic process. In this second cyclic process, the flowing water, which is available at a temperature of 15° to 20° C. gives off its heat to a pipe coil in which liquid ammonia evaporates at 6 atmospheres and 9° C. The ammonia is compressed to 30 atmospheres pressure and forced through a pipe coil within the second tank. The ammonia condenses at 66° C. and suffices to keep the second tank at 60° C. The condensed liquid ammonia is returned to the pipe coil in contact with the flowing water through a steam trap.

*German Pat. No.* 953,378 discloses a heat pump system wherein the temperature difference between ground water and low outside temperature is utilized to open up a considerable energy source. In particular, heat of a medium temperature is brought from a heat reservoir (ground water, river water, waste heat) to a higher temperature and the energy expenditure for moving the heat is covered at least partly by utilizing the temperature gradient between the temperature of a colder medium (e.g., outside air) and the temperature of the heat reservoir by means of a counterflow absorption machine. In its simplest form, the heat pump system comprises a closed absorption system (e.g., aqueous ammonia) linked to a closed compression system (e.g., freon as working medium). The condenser of the absorption system is cooled by the evaporator of the compression system. The condenser of the compression system is cooled by outside air. The evaporator of the absorption system is heated by ground water. The heat from the resorber is used to supply heat to a dwelling place. The heat for the de-aerator is supplied by ground water.

More particularly, ammonia vapor, under pressure, is fed from the evaporator into the resorber, where it is absorbed by a lean solution to form a rich solution and gives up heat of absorption at a higher temperature. The so-formed rich solution is expanded into the de-aerator, which is heated by ground water, to regenerate a lean solution and ammonia vapor. The lean solution is pumped back to the resorber. The vapor is fed to the condenser where it is cooled by the evaporator of the closed compression system to form liquefied ammonia and the liquefied ammonia is fed into the evaporator to regnerate the initial ammonia vapor. In the compression system gaseous freon exiting the evaporator is compressed and then condensed in the condenser by heat exchange with the ambient atmosphere. The condensed freon is then returned to the evaporator through a pressure-reducing valve.

*German Auslegeschrift No.* 1,125,956 discloses a refrigeration system utilizing an absorption system wherein the materials used as refrigerant (e.g., ammonia) and absorbent (e.g., petroleum or paraffin oil) have a miscibility gap in a temperature range below the temperature of the absorber and both are liquid in this range.

In particular, gaseous ammonia is fed, under pressure, into an absorber containing petroleum or paraffin oil under such temperature and pressure conditions as to cause dissolution of the ammonia in the petroleum or paraffin oil. This rich solution is fed through a heat exchanger, where it is cooled, and the miscibility between the ammonia and the petroleum or paraffin oil is reduced to such an extent that separation thereof begins. This partly separated solution is fed into an expeller where the solution is further cooled to the area where there is a pronounced miscibility gap. Consequently, the ammonia and the petroleum or paraffin oil completely separate in the expeller with the lighter liquid ammonia floating on top. The lean petroleum or paraffin oil is withdrawn from the expeller and passed through the heat exchanger where it cools the rich solution. The lean petroleum or paraffin oil is then passed into the absorber. The liquid ammonia is removed from the top of the expeller, passes through an expansion valve and then passes through two series-connected evaporators. In the first evaporator, about 20% of the ammonia evaporates and this evaporator is used to cool the expeller. In the second evaporator, the remaining liquid ammonia evaporates and is used to provide useful refrigeration. Heat of absorption in the absorber is removed by heat exchange with cooling water or air.

*Patnode, U.S. Pat. No.* 3,990,264, discloses a combination vapor compression-refrigeration cycle wherein the suction end of the compressor is exposed to both vapors discharged from the refrigeration evaporator and a mixture of oil foam and refrigeration vapors discharged from an absorption generator. As the mixture passes through the compressor, it absorbs the heat of compression and is discharged into a heat exchanger where heat energy is transferred to a reclaiming substance. Because of the absorptive process, relatively high temperatures are developed in the compressor discharge whereby the heat energy rejected to the relcaiming substance can be effectively utilized in domestic and industrial heating applications.

*Leonard, U.S. Reissue Pat. No.* 30,252, discloses a system for high temperature heat recovery in a refrigeration system wherein refrigerant vapors discharged from a compressor are exposed to, and condensed into, a strong absorbent solution to develop temperatures within the mixture that are in excess of the saturation temperature of the discharge vapors. The mixture is brought into a heat exchanger where the high temperature energy is recovered. The diluted absorbent in the mixture is then separated from unabsorbed refrigerant vapors and the dilute absorbent solution is flash cooled by expanding the dilute solution to the inlet pressure of the compressor. The separated unabsorbed refrigerant vapors are indirectly thermally contacted with the flash cooled solution in a concentrator where the unabsorbed refrigerant vapors are condensed, or partially condensed, to boil refrigerant from the dilute solution. The reconcentrated absorbent solution is recycled in the high lift circuit and the freed vapors are delivered to the inlet of the compressor. All of the remaining unabsorbed refrigerant vapors not condensed to concentrate the dilute absorbent solution are passed to a standard refrigeration condenser where they are condensed. The liquid condensate from this refrigeration condenser and the liquid condensate from the concentrator are collected together in a common chamber, the float chamber, and together passed through an expansion device into the evaporator where the liquid refrigerant is again used as the evaporate to accomplish chilling in a conventional manner.

*Rojey et al, U.S. Pat. No.* 4,420,946, discloses a refrigeration process using a phase separation technique. The technique comprises: compressing a refrigerant fluid and dissolving it in a solvent; cooling the resultant solution to form two distinct phases; separating the liquid phases; recycling the heavy phase; expanding and vaporizing the light phase to produce refrigeration; and recycling the vaporized light phase. A portion of the refrigeration produced is used to cool the aforementioned resultant solution and another portion is used to cool an external medium.

*Kaufman, U.S. Pat. No.* 4,442,677, discloses a thermal machine having a high-, intermediate-, and low-pressure states, including sealed chambers permitting maintenance of the respective pressures but permitting flow of vapor from one vessel to a second within a stage and permitting flow of an absorbent solution among the vessels in different stages. The intermediate-pressure stage includes resorption and regeneration vessels which are thermally coupled, respectively, to a generation vessel and an absorption vessel in the high- and low-pressure stages, so that a variable fraction of the absorber heat may be transferred to the regenerator and a variable fraction of the resorber heat may be transferred to the generator. This variable internal heat transfer permits the machine to adjust to a wide range of available heat source and heat rejection temperatures while maintaining high efficiency.

*Vakil, U.S. Pat. No.* 4,179,898, discloses a vapor compression heat pump device having a variable capacity wherein a multi-component working fluid mixture is utilized. The heat pump device comprises a condensing heat exchanger and an associated vapor-liquid separator connected to the compressor, a high-pressure liquid accumulator connected to the condenser and associated separator, a flow restricting device connected to the condenser and associated separator, an evaporating heat exchanger and associated low pressure accumulator connected to the flow restricting device, and the evaporating heat exchanger and low-pressure accumulator connected to the compressor. The capacity of the device is modulated during its heating mode by circulating a multi-component working fluid mixture vapor from the compressor to the condenser. The liquid from the condenser is circulated to the vapor-liquid separator and to the high-pressure accumulator whereby complete condensation is achieved. The mixture is circulated from the separator and the accumulator to the evaporator. The flow of the mixture from the accumulator to the evaporator is controlled selectively in response to changes in the evaporator temperature by the associated flow restricting device. The mixture then flows to a low-pressure accumulator. The density of the vapor in equilibrium with the liquid mixture in the low-pressure accumulator controls the rate of compression or the molar flow of the mixture to and through the compressor.

At higher outdoor temperatures, the complete condensation of and the restricted flow of the working fluid mixture from the vapor-liquid separator and the high-pressure accumulator results in the working fluid mixture which is circulated to the evaporator, being enriched in the high boiling point working fluid component. As the evaporator temperature decreases, the increase of mixture flow from the separator and the high-pressure accumulator enriches the working fluid mixture in the low boiling component. The additional flow of working fluid mixture through the evaporator and to the low-pressure accumulator results in a pressure increase in the low-pressure accumulator. The increase in working fluid mixture in the low-pressure accumulator increases the vapor density. The change from a low to a higher density in the vapor in the low-pressure accumulator increases the flow rate of the mixture through the compressor with a consequent increase in the heat exchanger duties and the compressor power input. Thus, the capacity of the device is modulated in the heating mode.

As may be readily ascertained absorption/desorption systems and vapor compression systems are well known for the transfer of heat, as well as phase separation systems, heat pumps using combined systems and heat pumps using two sources of heat.

Nonetheless, all current heat pump cycles employing non-azeotropic working fluid mixtures have one significant shortcoming: the capacity control is limited to a rather narrow range by the requirement that all liquid in the evaporator has to evaporate completely under steady state operation.

In this regard, conventional heat pumps operating with a single refrigerant as a working fluid show one major disadvantage: with decreasing outdoor temperature the capacity and the coefficient of performance (COP), i.e. the net heat withdrawn from the cold reservoir per unit of work done on the working fluid, decrease very rapidly. Therefore, around freezing temperatures, the heat pump is turned off and other means of heating have to be used. Consequently, heat pumps are under consideration which operate with a non-azeotropic refrigerant mixture. Compared to the conventional heat pump, these new types offer the following advantages: (1) reduced decrease of the capacity with decreasing outdoor temperatures, (2) continuous capacity control within rather narrow limits, and (3) a significant increase in COP, when counterflow heat exchangers can be employed. The first two advantages are achieved by adjusting the composition of the mixture. This can be done by either external control or internal "self-adjustment". The change of composition (at a given temperature) adjusts the pressure in the suction side of the compressor, resulting in a change of the refrigerant mass flow rate and therefor, the system's capacity. The larger the pressure change which can be obtained, the larger the range for capacity adjustments. A large change in pressure can only be achieved when the boiling temperatures of the pure components of the mixture are far apart.

Unlike pure refrigerants, the temperatures of non-azeotropic mixtures change as they evaporate, the size of this temperature change during evaporation being dependent on the difference in the boiling points of the pure components. It is important to note that this difference must not be too large since for given conditions the refrigerant mixture might not be evaporated completely, and could harm the compressor by feeding it a two-phase mixture. This requirement "for complete evaporation" limits the practical application of non-azeotropic refrigerant mixtures in traditional heat pump cycles striving for large capacity adjustments. .

Nonetheless, in order to achieve an effective capacity adjustment, a large difference in boiling points (ideally, as large as possible) is desirable, while for the heat pump cycles employed to date only a limited difference in boiling points is acceptable. In order to overcome this dichotomy, a heat pump with solution circuit (HPSC) has been proposed.

In the HPSC, a mixture is chosen where the boiling points of its components are deliberately far apart. The higher boiling component, in fact, is selected so as to not substantially evaporate under the normal operating conditions of the cycle. This higher boiling component instead is recirculated through the heat pump (E. Altenkirch, "Refrigeration Apparatus with Solution Circuit", Kaltetechnik 2 (1950), pp. 251, 279, 310 and G. Alefeld, "Heat Conversion System", to be published).

FIG. 1 illustrates an apparatus utilizing this prior art technique. In particular, a vapor/liquid mixture of the higher boiling and lower boiling components enters the desorber 1 at end 3. In the desorber 1, only the lower boiling component is desorbed and two streams (a vapor rich in the lower boiling component and a liquid rich in the higher boiling component) are formed. The two streams are separated from one another and exit the desorber 1 at end 5. The vapor rich in the lower boiling component is delivered to the compressor 7, compressed therein, and then passed to the absorber 9. The liquid rich in the higher boiling component (absorbent) is supplied to absorber 9 by pump 11 and heat exchanger 23. The vapor is absorbed into the liquid absorbent in absorber 9 and the combined liquid streams leave the absorber and are returned to desorber 1 via pressure-reducing valve 13. The adjustment of composition is easily effected, since the vapor passing through the compressor 7 is almost pure refrigerant (lower boiling component), and the compressed vapor can be controllably rerouted around absorber 9 by activation of control valves 15 and 17. The rerouted vapor can then be condensed and stored in accumulator 19. The stored condensed vapor can then be controllably fed to the desorber 1 via pressure-reducing valve 21. The cycle is a closed cycle.

In order to provide a more intuitive understanding of the operation of this heat pump cycle and the apparatus of FIG. 1, FIG. 2 shows a log (pressure) vs—1/T diagram for the cycle with vapor pressure lines for the lower boiling component (refrigerant) and the higher boiling component (absorbent) indicated. Superimposed on the graph, are elements of the apparatus so that pressure, temperature and composition changes within those heat exchangers which accommodate a phase change become obvious from the graph. Dashed lines $d_i$ ($i=1$, 2 or 3) indicate the direction of the change of composition with decreasing outdoor temperature ($d_3$ representing the direction of change at a higher temperature than $d_2$ which in turn represents the direction of change at a higher temperature than $d_1$). It thus becomes apparent that with decreasing outdoor temperature, the suction side pressure (and therefore the capacity) can be increased by mere adjustment of the composition of the incoming liquid stream. (The capacity can also be adjusted at constant outdoor temperature to meet a varying load.)

There is another advantage to this design which is not obtainable from conventional heat pumps. The circulating solution allows an efficient internal heat exchange, so that flashing at the desorber inlet is considerably reduced, thus increasing the capacity without changing the mass flow rate. This internal heat exchange requires an additional heat exchanger which is indicated in FIG. 1, as the element 23 (a countercurrent heat exchanger).

An obvious disadvantage of this heat pump cycle, i.e. the HPSC, is the fact that a solution pump is necessary. The additional heat exchanger also adds to the cost of the unit but, on the other hand, this expedient has been considered for conventional heat pumps utilizing mixed fluids, since it can increase capacity. However, there is still one problem inherent in all of the heat pump cycles discussed: with decreasing outdoor temperature the pressure ratio will increase in order to maintain the absorber (condenser) at the required high indoor temperature.

SUMMARY OF THE INVENTION

The present invention relates to an advanced heat pump cycle using non-azeotropic working fluid mixtures which is able to overcome the above-noted restrictions in capacity control, and to an apparatus for effecting such a heat pump cycle.

It is one object of the present invention to provide a vapor compression heat pump cycle which allows adjustment of the heat pump capacity in a wide range independent of outdoor conditions, so that the loadline can be matched with a continuously operating single speed compressor under almost all conditions.

It is a further object of the present invention to provide a vapor compression heat pump cycle wherein high temperature lifts can be obtained at low pressure ratios.

It is a still further object of the present invention to provide a vapor compression heat pump cycle which can operate independently of the vapor pressure/temperature relationship usually dictated by single refrigerants or non-azeotropic mixtures of refrigerants.

It is a still further object of the present invention to provide apparatus for effectuating a vapor compression heat pump cycle wherein the heat pump can work along an "effective vapor pressure line" which can be shifted to different pressure and temperature values and the slope of which can be adjusted.

The above-noted objects and other objects which will become apparent hereinafter are attained by the present invention, in a first embodiment, by the provision of a method of transferring heat from a first fluid having a temperature $T_1$ to a second fluid having a temperature $T_2$, when said temperature $T_2$ is greater than said temperature $T_1$, the method comprising:

providing a third fluid, comprising a mixture of a higher boiling component and a lower boiling component, having a temperature $T_A$, $T_A$ being less than $T_1$, said higher boiling component and said lower boiling component being miscible, said mixture releasing heat upon absorption of said lower boiling component therein and absorbing heat upon desorption of said lower boiling component therefrom;

adding heat to said third fluid to raise the temperature of the third fluid to a temperature $T_B$, $T_B$ being greater than $T_A$ and less than or substantially equal to $T_1$, whereby at least a portion of said lower boiling component desorbs from said third fluid to form a first liquid rich in said higher boiling component and a first vapor rich in said lower boiling component;

separating said first liquid from said first vapor;

compressing said first vapor to form a secondary pressurized vapor stream;

pumping said first liquid into contact with said secondary pressurized vapor stream to form a pressurized fourth fluid having a temperature $T_C$, $T_C$ being greater than $T_2$;

removing heat from said fourth fluid to lower the temperature of said fourth fluid to a temperature $T_D$, $T_D$ being less than $T_C$ and greater than or substantially equal to $T_2$, whereby said secondary pressurized vapor stream is absorbed to form, in admixture with said first liquid, a pressurized second liquid, said temperature $T_D$ being greater than $T_A$ and less than $T_B$, said temperature $T_B$ being greater than $T_D$ and less than $T_C$;

expanding said pressurized second liquid to form said third fluid;

wherein said addition of heat to said third fluid is effected by indirect thermal contact with said first fluid and indirect thermal contact with said fourth fluid; and said removal of heat from said fourth fluid is effected by indirect thermal contact with said second fluid and indirect thermal contact with said third fluid.

In another aspect, the present invention provides a method of transferring heat from a first fluid having a temperature $T_1$ to a second fluid having a temperature $T_2$, when said temperature $T_2$ is greater than said temperature $T_1$, the method comprising:

(a) providing a third fluid, comprising a mixture of a higher boiling component and a lower boiling component, having a temperature $T_A$, $T_A$ being less than $T_1$, said higher boiling component and said lower boiling component being miscible, said mixture releasing heat upon absorption of said lower boiling component therein and absorbing heat upon desorption of said lower boiling component therefrom;

(b) adding heat to said third fluid to raise the temperature of said third fluid to a temperature $T_B$, $T_B$ being greater than $T_A$ and less than or substantially equal to $T_1$, whereby at least a portion of said lower boiling component desorbs from said third fluid to form a first liquid rich in said higher boiling component and a first vapor rich in said lower boiling component;

(c) separating said first liquid from said first vapor;

(d) compressing said first vapor to form a first pressurized vapor;

(e) controllably separating said first pressurized vapor into a primary pressurized vapor stream and a secondary pressurized vapor stream;

(f) pumping said first liquid into contact with said secondary pressurized vapor stream to form a pressurized fourth fluid having a temperature $T_C$, $T_C$ being greater than $T_2$;

(g) removing heat from said fourth fluid to lower the temperature of said fourth fluid to a temperature $T_D$, $T_D$ being less than $T_C$ and greater than or substantially equal to $T_2$, whereby said secondary pressurized vapor stream is absorbed to form, in admixture with said first liquid, a pressurized second liquid;

(h) expanding said pressurized second liquid to form a fifth fluid;

(i) controlling the amount of said first pressurized vapor separated into said primary pressurized vapor stream and recycling a controlled depressurized portion thereof for admixture with said fifth fluid to form said third fluid so that said temperature $T_D$ is greater than $T_A$ and less than $T_B$ and said temperature $T_B$ is greater than $T_D$ and less than $T_C$;

wherein said addition of heat to said third fluid is effected by indirect thermal contact with said first fluid and indirect thermal contact with said fourth fluid; and said removal of heat from said fourth fluid is effected by indirect thermal contact with said second fluid and indirect thermal contact with said third fluid.

In a second embodiment, the present invention provides an apparatus for transferring heat from a first fluid having a temperature $T_1$ to a second fluid having a temperature $T_2$, when said temperature $T_2$ is greater than said temperature $T_1$, said apparatus comprising a first heat exchanger means for indirectly thermally contacting a third fluid, comprising a high boiling component and a low boiling component, with said first fluid to raise the temperature of said third fluid from a temperature $T_A$ to a temperature intermediate said temperature $T_A$ and a temperature $T_B$, wherein $T_A$ is less than $T_B$ and $T_B$ is less than or substantially equal to $T_1$, whereby a first portion of said lower boiling component desorbs from said third fluid to form a first liquid rich in said higher boiling component and a first vapor rich in said lower boiling component;

separator means, connected to said first heat exchanger by first conduit means, for separating said first liquid from said first vapor;

compressor means, operably connected to said separator means, for compressing said first vapor to form a first pressurized vapor;

pumping means, operably connected to said seperator means, for pumping said first liquid;

mixing means, operably connected to said compressor means and said pumping means, for mixing said first pressurized vapor and said first liquid to form a fourth fluid having a temperature $T_C$;

second heat exchanger means, operably connected to said mixing means, for indirectly thermally contacting said fourth fluid with said second fluid to lower the temperature of said fourth fluid to a temperature intermediate said temperature $T_C$ and a temperature $T_D$, wherein $T_C$ is greater than $T_D$ and $T_D$ is greater than or equal to $T_2$, whereby a first portion of said first pressurized vapor is absorbed by said first liquid to form a pressurized second liquid;

expansion valve means, connected to said second heat exchanger by second conduit means, for releasing pressure on said pressurized second liquid to form said third fluid;

said first conduit means and said second conduit means, in combination, cooperating to form a third heat exchanger means for indirectly thermally contacting said third fluid and said fourth fluid, whereby a further portion of said lower boiling component desorbs from said third fluid and the temperature of said third fluid is raised to $T_B$ and whereby a further portion of said first pressurized vapor is absorbed by said first liquid and the temperature of said fourth fluid is lowered to $T_D$.

In a third embodiment the present invention provides a method of generating power utilizing a first fluid having a temperature $T_1$ and a second fluid having a temperature $T_2$, said temperature $T_2$ being greater than said temperature $T_1$, the method comprising:

providing a third fluid, comprising a mixture of a higher boiling component and a lower boiling component, having a temperature $T_A$, $T_A$ being less than $T_2$, said higher boiling component and said lower boiling component being miscible, said mixture releasing heat upon absorption of said lower boiling component therein and absorbing heat upon desorption of said lower boiling component therefrom;

adding heat to said third fluid to raise the temperature of the third fluid to a temperature $T_B$, $T_B$ being greater than $T_A$ and less than or substantially equal to $T_2$, whereby at least a portion of said lower boiling component desorbs from said third fluid to form a first pressurized liquid rich in said higher boiling component and a first pressurized vapor rich in said lower boiling component;

separating said first pressurized liquid from said first pressurized vapor;

expanding said first pressurized vapor through a turbine to generate power thereby and produce a first depressurized vapor;

expanding said first pressurized liquid into contact with said first depressurized vapor to form a fourth fluid having a temperature $T_C$, $T_C$ being greater than $T_1$;

removing heat from said fourth fluid to lower the temperature of said fourth fluid to a temperature $T_D$, $T_D$ being less than $T_C$ and greater than or substantially equal to $T_1$, whereby said first depressurized vapor is absorbed, to form in admixture with said first depressurized liquid, a depressurized third liquid, said temperature $T_C$ being greater than $T_A$ and less than $T_B$, said temperature $T_A$ being greater than $T_D$ and less than $T_C$;

pumping said depressurized third liquid to form said third fluid;

wherein said addition of heat to said third fluid is effected by indirect thermal contact with said second fluid and indirect thermal contact with said fourth fluid; and said removal of heat from said fourth fluid is effected by indirect thermal contact with said first fluid and indirect thermal contact with said third fluid.

In a fourth embodiment, the present invention provides a method of transferring heat from a first fluid having a temperature $T_1$ to a second fluid having a temperature $T_2$, when said temperature $T_2$ is greater than said temperature $T_1$, the method comprising:

providing a third fluid, comprising a mixture of a higher boiling component and a lower boiling component, having a temperature $T_A$, $T_A$ being less than $T_1$, said higher boiling component and said lower boiling component being miscible, said mixture releasing heat upon adsorption of said lower boiling component therein and absorbing heat upon desorption of said lower boiling component therefrom;

adding heat to said third fluid to raise the temperature of the third fluid to a temperature $T_B$, $T_B$ being greater than $T_A$ and less than or substantially equal to $T_1$, whereby said higher boiling component and said lower boiling component are both completely vaporized to form a first vapor;

compressing said first vapor to form a secondary pressurized vapor stream;

removing heat from said secondary pressurized vapor stream to lower the temperature of said secondary pressurized vapor stream to a temperature $T_D$, $T_D$ being less than $T_C$ and greater than or substantially equal to $T_2$, whereby said secondary pressurized vapor stream is totally condensed to form a pressurized second liquid, said temperature $T_D$ being greater than $T_A$ and less than $T_B$, said temperature $T_B$ being greater than $T_D$ and less than $T_C$;

expanding said pressurized second liquid to form said third fluid;

wherein said addition of heat to said third fluid is effected by indirect thermal contact with said first fluid and indirect thermal contact with said secondary pressurized vapor stream; and said removal of heat from said secondary pressurized vapor stream is effected by indirect thermal contact with said second fluid and indirect thermal contact with said third fluid.

BRIEF DESCRIPTION OF THE DRAWING FIGURES

DETAILED DESCRIPTION OF THE INVENTION

Figure 1:
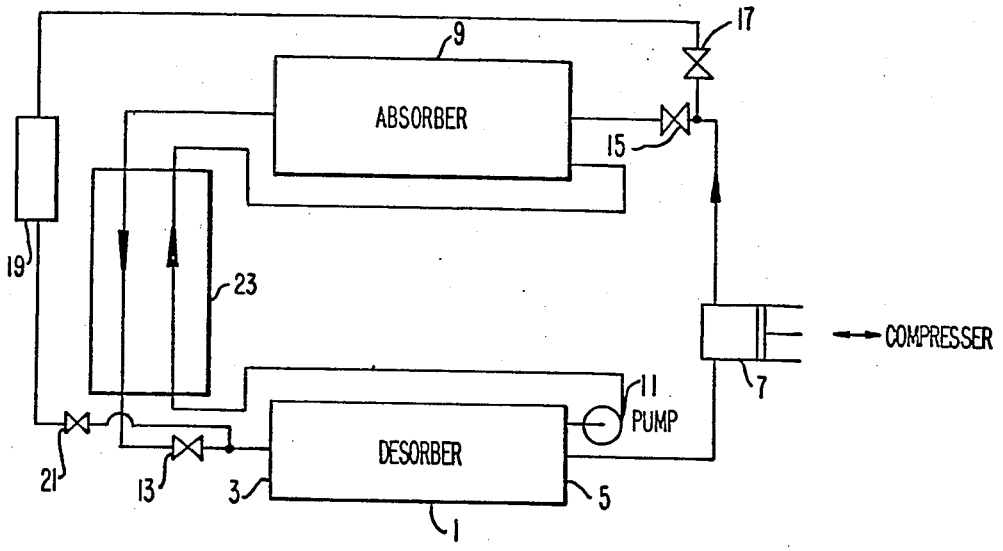
FIG. 1 PRIOR ART
FIG. 1 is a schematic drawing of an apparatus according to the prior art, the heat pump with solution circuit (HPSC).
Figure 2:
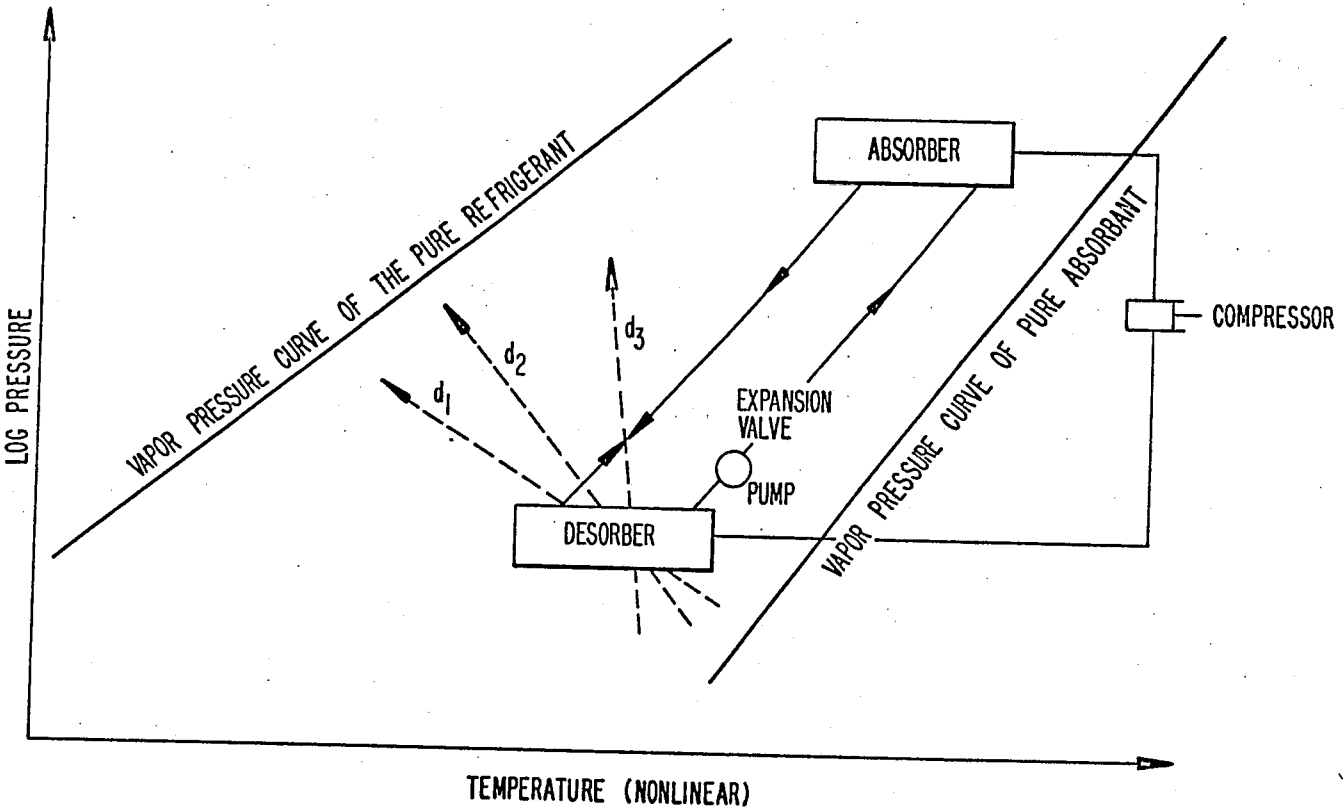
FIG. 2 PRIOR ART
FIG. 2 is a pressure/temperature diagram illustrating certain principles upon which the prior art apparatus of FIG. 1 is based.

The heat pump cycle described hereinafter is useful for both heating and cooling applications. Although it is hereinafter discussed only in terms of heating applications, this does not constitute a limitation on the invention.

The present invention utilizes a non-azeotropic mixture, comprising a mixture of higher boiling component (absorbent) and a lower boiling component (refrigerant), as the working fluid for the heat pump cycle. By higher boiling component is meant the one of the components which has the higher boiling point at a fixed pressure, i.e. at atmospheric pressure. Likewise, by lower boiling component is meant the one of the components which has the lower boiling point at atmospheric pressure.

In order to achieve an effective capacity adjustment, a large difference in the boiling points is desirable. Typically, a difference in the boiling points of at least about 30° C. will be operable, preferably the boiling point differential will be 50° C. or greater. It is especially preferred that the higher boiling component not substantially evaporate under the normal operating conditions of the heat pump cycle.

Low boiling components suitable for use in the present invention include inorganic and organic materials. Exemplary inorganic materials are ammonia ($NH_3$, −33.3° C.), carbon dioxide ($CO_2$, −78.4° C.) and sulfur dioxide ($SO_2$, −10° C.). Exemplary organic materials are hydrocarbons such as the lower alkanes, e.g., ethane ($C_2H_6$, −88.8° C.), propane ($C_3H_8$, −42.1° C.) and butane ($C_4H_{10}$, −0.5° C.); alcohols such as methanol ($CH_3OH$, 64.5° C.), ethanol ($C_2H_5OH$, 78.3° C.), propanol ($C_3H_7OH$, 97° C.) and butanol ($C_4H_9OH$, 118° C.); amines such as methyl amine ($CH_3NH_2$, −6.7° C.), ethyl amine ($C_2H_5NH_2$, 16.6° C.), propyl amine ($C_3H_7NH_2$, 49° C.), and butyl amine ($C_4H_9NH_2$, 78° C.), unsaturated hydrocarbons such as propylene ($C_3H_6$, −47.7° C.); isomeric hydrocarbons such as isobutane (i-$C_4H_{10}$, −12° C.); halocarbons such as tetrafluoromethane ($CF_4$, −127.9° C.), trifluoromethane ($CHF_3$, −82.1° C.), chlorotrifluoromethane ($CClF_3$, −81.4° C.), bromotrifluoromethane ($CBrF_3$, −57.8° C.), chlorodifluoromethane ($CHClF_2$, −40.8° C.), chloropentafluoro ethane ($CClF_2CF_3$, −39.1° C.), dichlorodifluoromethane ($CCl_2F_2$, −29.8° C.), difluoroethane ($CH_3CHF_2$, −25° C.), methyl chloride ($CH_3Cl$, −12.4° C.), chlorodifluoroethane ($CH_3CClF_2$−9.8° C.), octofluorocyclobutane ($C_4F_8$, −5.8° C.), dichlorotetrafluoroethane ($CClF_2CClF_2$, 3.8° C.), dichlorofluoromethane ($CHCl_2F$, 8.9° C.), trichlorofluoromethane ($CCl_3F$, 23.8° C.) and dichlorohexafluoropropane ($C_3Cl_2F_6$, 35.7° C.); mixtures of halocarbons such as refrigerant R-502 (48.8% chlorodifluoromethane and 51.2% chloropentafluoroethane, −45.4° C.) and refrigerant R-500 (73.8% dichlorodifluoromethane and 26.2% difluoroethane ($CH_3CHF_2$), −33.5° C.). All boiling points are at normal atmospheric pressure and all percentages are by mass, unless otherwise noted.

High boiling components suitable for use in the present invention also include inorganic and organic materials. Exemplary inorganic materials are water; aqueous salt solutions such as alkali or alkaline earth metal salt solutions including lithium bromide, lithium chloride, calcium chloride, other salts such as zinc bromide and mixtures of such salts; and liquid ammonia solutions of salts such as alkali or alkaline earth metal salts including lithium bromide, lithium chloride, calcium chloride, other salts such as zinc bromide, mixtures of such salts, thiocyanate salts such as sodium thiocyanate, and nitrates such as lithium nitrate. Exemplary organic materials are hydrocarbons such as the alkanes, e.g., butane ($C_4H_{10}$, −0.5° C.), pentane ($C_5H_{12}$, −36° C.) hexane ($C_6H_{14}$, 69° C.), and higher alkanes; alcohols such as methanol ($CH_3OH$, 64.5° C.) and ethanol ($C_2H_5OH$, 78.3° C.); alcoholic salt solutions such as alkali and alkaline earth metal salt solutions including lithium bromide and calcium chloride; methyl amine salt solutions of nitrates such as lithium nitrate or thiocyanates such as sodium thiocyanate; halocarbons such as dichlorotetrafluoroethane ($CClF_2CClF_2$, 3.8° C.), dichlorofluoromethane ($CHCl_2F$, 8.9° C.), trichlorofluoromethane ($CCl_3F$, 23.8° C.), dichlorohexafluoropropane ($C_3Cl_2F_6$, 35.7° C.), methylene chloride ($CH_2Cl_2$, 40.2° C.), trichlorotrifluoroethane ($CCl_2FCClF_2$, 47.6° C.), dichloroethylene ($CHCl{=}CHCl$, 47.8° C.), trichloroethylene ($CHCl{=}CCl_2$, 87.2° C.), 1,1,1-trichloroethane ($CH_3CCl_3$, 74° C.), 1,1,2-trichloroethane ($CH_2ClCHCl_2$, 113° C.), dichlorotrifluoroethane ($CHCl_2CF_3$, 28.7° C.), 1,1,2-trifluoro-1,2 dichloroethane ($CHClFClF_2$, 29° C.) and trifluoroethanol ($CF_3CH_2OH$, 73.6° C.); esters such as methyl formate ($CHOOCH_3$, 31.8° C.); ethers such as ethyl ether ($C_2H_5OC_2H_5$, 34.6° C.), ethyltetrahydrofurfurylether ($C_4H_7OCH_2OC_2H_5$, 156° C.), tetraethyleneglycoldimethyl ether ($C_{10}H_{22}O_5$, 275.8° C.), tetraethyleneglycol ($HO(C_2H_4O)_4H$, 328° C.), and diethyleneglycoldimethylether ($CH_3O(C_2H_4O)_2CH_3$, 162° C.); amides such as dimethylformamide ($HCON(CH_3)_2$, 153° C.), diethylformamide ($HCON(C_2H_5)_2$, 177°-178° C.) and hexamethylphosphoric acid triamide ($[(CH_3)_2N]_3PO$, 98°-100° C.); organophosphates such as tri-n-butyl phosphate ($(C_4H_9O)_3PO$, 183° C.); and heterocyclic compounds such as N-methylpyrrolidone ($C_4H_6NOCH_3$, 197°-202° C. (736 mm Hg.)).

As may be readily ascertained, it is possible for any particular fluid listed as a refrigerant to be used as an absorbent in low temperature applications; and, likewise, any particular fluid listed as an absorbent may be used as a refrigerant in high temperature applications. The final decision depends primarily on the particular application (temperature range) envisioned for use as well as other factors such as specific volume, transport properties (such as viscosity), and materials of construction. Nonetheless, certain preferred combinations (refrigerant/absorbent) can be set forth: methyl amine/water; methyl amine/aqueous LiBr; ammonia/liquid ammonia+$LiNO_3$; ammonia/liquid ammonia+NaSCN; methyl amine/methyl amine+$LiNO_3$; methyl amine/-methyl amine+NaSCN. Particularly preferred combinations (refrigerant/absorbent) are bromotrifluoromethane/ trichlorofluoromethane; chlorodifluoromethane/dichlorotetrafluoroethane; $NH_3$/aqueous LiBr; and ammonia/water.

Aside from a suitable difference in the boiling points of the refrigerant and absorbent, the refrigerant and absorbent must be miscible with one another in the intended range of use. Other factors which will influence the choice of a particular combination include toxicity, both from the standpoint of hazards posed during manufacture and hazards posed by leakage during operation; corrosiveness, especially from the standpoint of being determinative of the useful life of the apparatus; cost, as determinative of a portion of the economics of the system; suitable transport properties, such as viscosity; thermal conductivity; density; absorption rates; surface tension; and a low specific heat coupled with a high latent heat.

Figure 3:
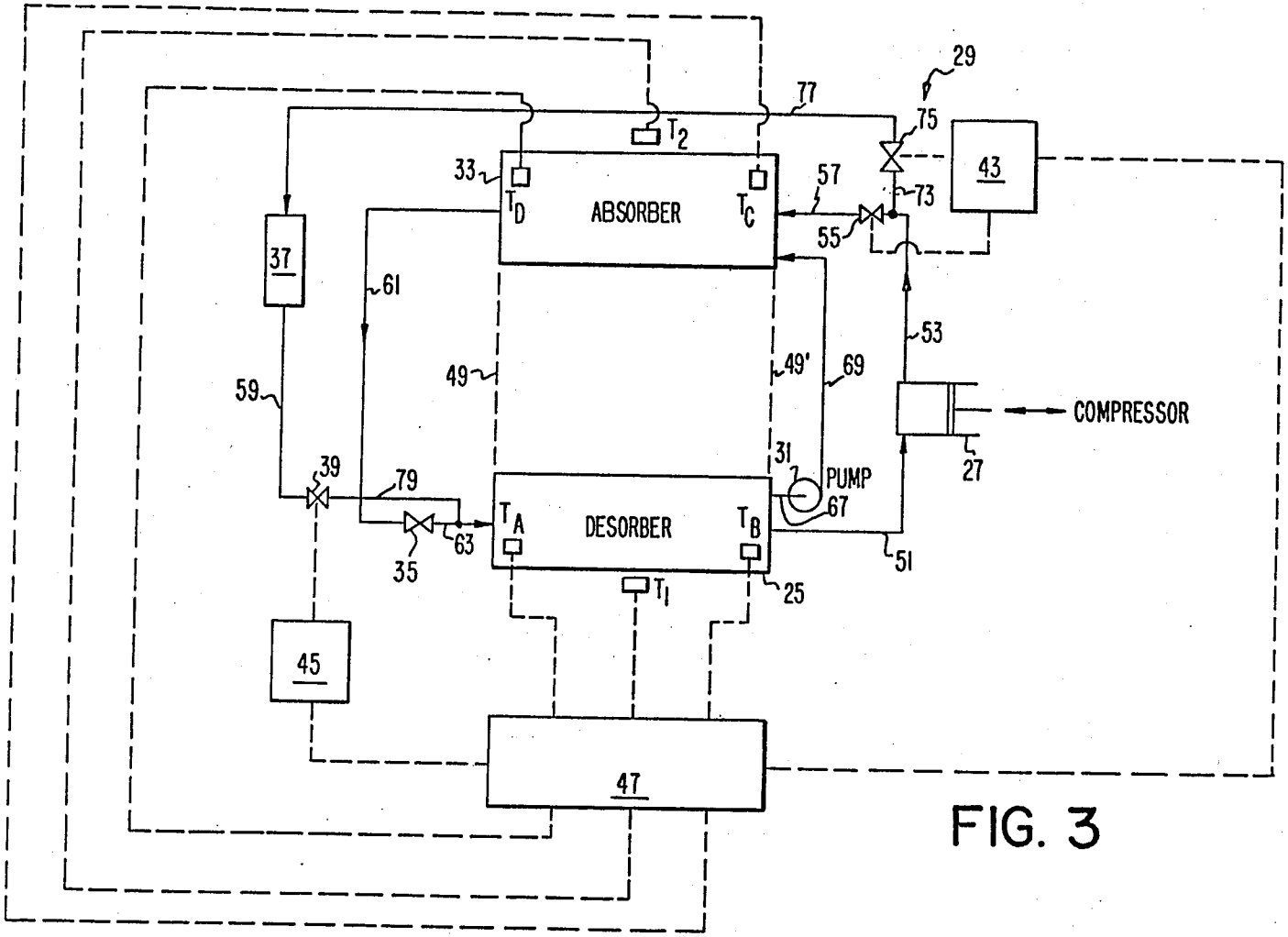
FIG. 3 is a schematic drawing of an apparatus according to the present invention.

Having selected a suitable working fluid, FIG. 3 schematically illustrates an apparatus for effectively utilizing the working fluid in the present heat pump cycle.

As shown in FIG. 3, the heat pump apparatus for transferring heat from a first fluid (not shown) having a temperature $T_1$ to a second fluid (not shown) having a temperature $T_2$, when said temperature $T_2$ is greater than said temperature $T_1$, includes: a first heat exchanger (desorber) 25; a compressor 27; a vapor stream separator, generally indicated at 29; a liquid pump 31; a second heat exchanger (absorber) 33; a first expansion valve 35; an accumulator 37; a second expansion valve 39; a first controller 43; a second controller 45; a third controller 47; and a thermal connector, generally indicated by dashed lines 49, 49'.

The first heat exchanger (desorber) 25 is connected to compressor 27 by first vapor conduit 51. Compressor 27 is connected to the second heat exchanger (absorber) 33 by way of second vapor conduit 53, first control valve 55, and third vapor conduit 57. The second heat exchanger (absorber) 33 is connected to the first heat exchanger (desorber) 25 by way of first liquid conduit 61, the first expansion valve 35 and first fluid conduit 63. The first heat exchanger (desorber) 25 is also connected to the second heat exchanger (absorber) 33 by way of second liquid conduit 67, pump 31, and third liquid conduit 69. The second vapor conduit 53 is connected to accumulator 37 by way of fourth vapor conduit 73, second control valve 75, and fifth vapor conduit 77. In turn, accumulator/condenser 37 is connected to first heat exchanger (desorber) 25 by way of fourth liquid conduit, second expansion valve 39, second fluid conduit 79 and first fluid conduit 63.

In operation, heat is transferred from a first fluid (not shown) having a temperature $T_1$ to a second fluid (not shown) having a temperature $T_2$ when the temperature $T_2$ is greater than the temperature $T_1$ by supplying a third fluid comprising a mixture of a higher boiling component and a lower boiling component to the first heat exchanger (desorber) 25 via fluid conduit 63. The third fluid enters the first heat exchanger (desorber) at a temperature $T_A$ ($T_A$ being less than $T_1$). Heat is transferred from the first fluid to the third fluid by indirect thermal contact in the first heat exchanger (desorber) 25 to raise the temperature of the third fluid to a temperature $T_B$ ($T_B$ being greater than $T_A$ but less than or substantially equal to $T_1$), whereby at least a portion of the lower boiling component evaporates from the third fluid to form a first liquid rich in the higher boiling component and a first vapor rich in the lower boiling component. The first liquid and the first vapor are separated from one another in the first heat exchanger (desorber) 25 by vapor-liquid separation means, well-known in themselves in the art, e.g., entrainment baffles or meshes over a liquid sump. The first vapor is then passed through vapor conduit 51 to compressor 27 wherein it is compressed to form a first pressurized vapor. The first pressurized vapor is fed via vapor conduit 53 to vapor stream separator 29 wherein it is separated into a primary pressurized vapor stream and a secondary pressurized vapor stream.

The vapor stream separator 29 comprises a first control valve 55, a second control valve 75 and a first controller 43. The control valves 55 and 75 can be of conventional design and may be actuated hydraulically, pneumatically or electrically, preferably electrically. The degree of opening of each of the valves is set by first controller 43 which sends control signals (shown as dotted lines) to each of the valves. The first controller 43 is, in turn, controlled by the third controller 47, the operation of which will be explained hereinafter.

The first liquid is pumped from the first heat exchanger (desorber) 25 by liquid conduit 67 via pump 31 and liquid conduit 69 to the second heat exchanger (absorber) 33. Simultaneously the secondary pressurized vapor stream is fed via vapor conduit 57 into the second heat exchanger (absorber) 33 to mix with the first liquid and form a pressurized fourth fluid having a temperature $T_C$ ($T_C$ being greater than $T_2$).

Heat is released from the fourth fluid to the second fluid (not shown) via indirect thermal contact therebetween in the second heat excahnger (absorber) 33 to lower the temperature of the fourth fluid to a temperature $T_D$ ($T_D$ being less than $T_C$ but greater than or substantially equal to $T_2$), whereby the secondary pressurized vapor stream contained in said fourth fluid is absorbed to form, in admixture with the first liquid contained in the fourth fluid, a pressurized second liquid.

The pressurized second liquid is removed from the second heat exchanger (absorber) 33 by way of liquid conduit 61 to expansion valve 35 wherein the pressure on the second liquid is released to form a fifth fluid.

The primary pressurized vapor stream, meanwhile, has been fed from control valve 75 to accumulator 37 wherein the primary pressurized vapor stream is held. In the preferred form of the invention, the primary pressurized vapor stream is condensed to a liquid within accumulator 37 to form a pressurized third liquid by indirect thermal contact with the first fluid. The pressurized third liquid is stored in the accumulator 37 until needed. When needed, the pressurized third liquid is fed via liquid conduit 59 to the second expansion valve 39 wherein the pressure on the third liquid is released to form a sixth fluid. The second expansion valve 39 is hydraulically, pneumatically or electrically controlled, preferably electrically controlled, via a signal (shown as a dotted line) received from the second controller 45 to feed a controlled amount of the third liquid therethrough. The second controller 45 is, in turn, controlled by the third controller 47, whose operation wil be explained hereinafter.

Alternatively, the accumulator 37 and the second expansion valve 39 may be eliminated in favor of a distillation tower whereby a fluid of reduced pressure may be formed from the primary pressurized vapor stream, the amount of such fluid being dependent on the operating conditions of the distillation tower.

The so-formed fifth fluid is fed into fluid conduit 63 wherein it is admixed with the so-formed sixth fluid which is fed thereto via fluid conduit 79 to reconstitute the third fluid.

As indicated by dashed lines 49, 49' the first heat exchanger (desorber) 25 and the second heat exchanger (absorber) 33 are thermally connected so that the third and fourth fluids are in indirect, countercurrent, thermal contact while the first fluid and the third fluid are in indirect thermal contact with one another and while the second fluid and the fourth fluid are in indirect, thermal contact with one another.

The controller 47 receives signals (represented by dotted lines) representative of the temperature $T_A$, $T_B$, $T_C$, $T_D$, $T_1$ and $T_2$ from thermal sensors (indicated by similarly labelled boxes, e.g., thermocouples) and sends control signals (also represented by dotted lines) to the first controller 43 and the second controller 45. Thus, the third controller 47 controls the amount of the first pressurized vapor which is separated off as the primary pressurized vapor stream (and thus the composition of the fourth fluid); and controls the amount of the third liquid expanded to form the sixth fluid (and thus the composition of the third fluid) so that the temperature $T_D$ is greater than $T_A$ and less than $T_B$ and the temperature $T_B$ is greater than $T_D$ and less than $T_C$.

For instance, by increasing the amount of vapor diverted to the primary pressurized vapor stream, the temperature $T_C$ can be increased, and vice versa. Likewise, by decreasing the amount of the third liquid expanded through expansion valve 39, the temperature $T_A$ can be lowered, and vice versa.

It should be noted that for a given set of temperatures ($T_1$, $T_2$), if the apparatus is balanced to produce mass flow rates through the pump and compressor which are of the same order of magnitude then this will produce overlapping temperatures in the absorber and desorber. Thus, the controller 47 is not absolutely necessary for the operation of the system, but does provide a convenient means for adjusting the system during temperature ($T_1$, $T_2$) changes so as to maintain a required capacity.

Thus, the present invention utilizes a heat pump cycle with overlapping temperature intervals in the desorber and absorber. The major advantage of this is that the pressure ratio can be kept low at all times while an unusually high temperature difference can be overcome, i.e. the strain of the high pressure ratio is taken off the compressor. Of course, all of the advantages of the HPSC are retained. In effect, the range of applicability of vapor compression heat pumps is dramatically expanded.

Figure 4:
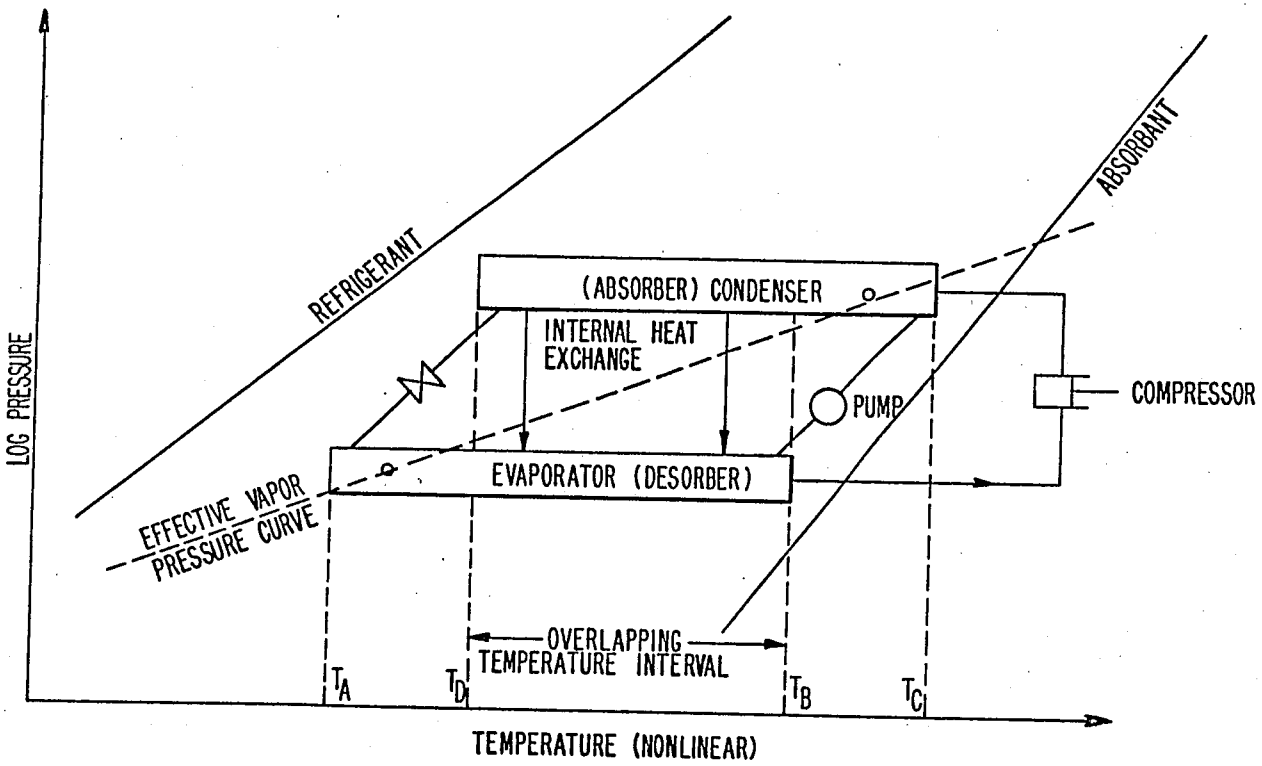
FIG. 4 is a pressure/temperature diagram illustrating the operating principles of the apparatus of FIG. 3.

As will be appreciated, this range expansion is achieved by allowing the composition changes, and therefore the temperature intervals in the evaporator and condenser, to be deliberately large, so that the temperature intervals in evaporator and condenser overlap. In this overlapping range (see FIG. 4), i.e. $T_D$–$T_B$, counterflow heat exchange between condenser and evaporator is allowed to take place (as shown by the arrows in FIG. 4). Consequently, the temperature ranges where heat exchange with outside sources and sinks occur are not bound to a special vapor pressure curve, they rather refer to vapor pressure lines of different compositions. This means evaporating and condensing pressures and temperatures are now independent from each other and from a given vapor pressure line due to the overlap of temperatures. Expressed in other terms, the heat pump is operating along an "effective vapor pressure curve" as shown in FIG. 4.

Consequently, the pressure ratio can be limited to an acceptable value while the temperature lifts can be chosen independently. This feature is, of course, consistent with thermodynamics. A more detailed analysis shows that now the heat pump cycle operates with an effective vapor pressure line the slope of which can be considerably lower than that of any other pure component or single mixture of components. As such, the latent heat will decrease and the overall mass flow rate will increase. The overall result is that a low pressure ratio and high temperature lift is traded for higher mass flow rates.

The preferred embodiment of the present invention will now be described by reference to FIG. 5. It should be noted that this embodiment consists of heat exchangers and off the shelf machines which can be built with existing materials and components. Since different methods and ways can be employed to realize the same cycle, the description given here should be understood as being exemplary only and not limitative of the scope of the invention.

All heat exchangers of the entire cycle are built in one part, preferably, but not necessarily, from conventional steel tubes or any other material suitable to contain the fluids involved in the desired pressure and temperature ranges.

Figure 5:
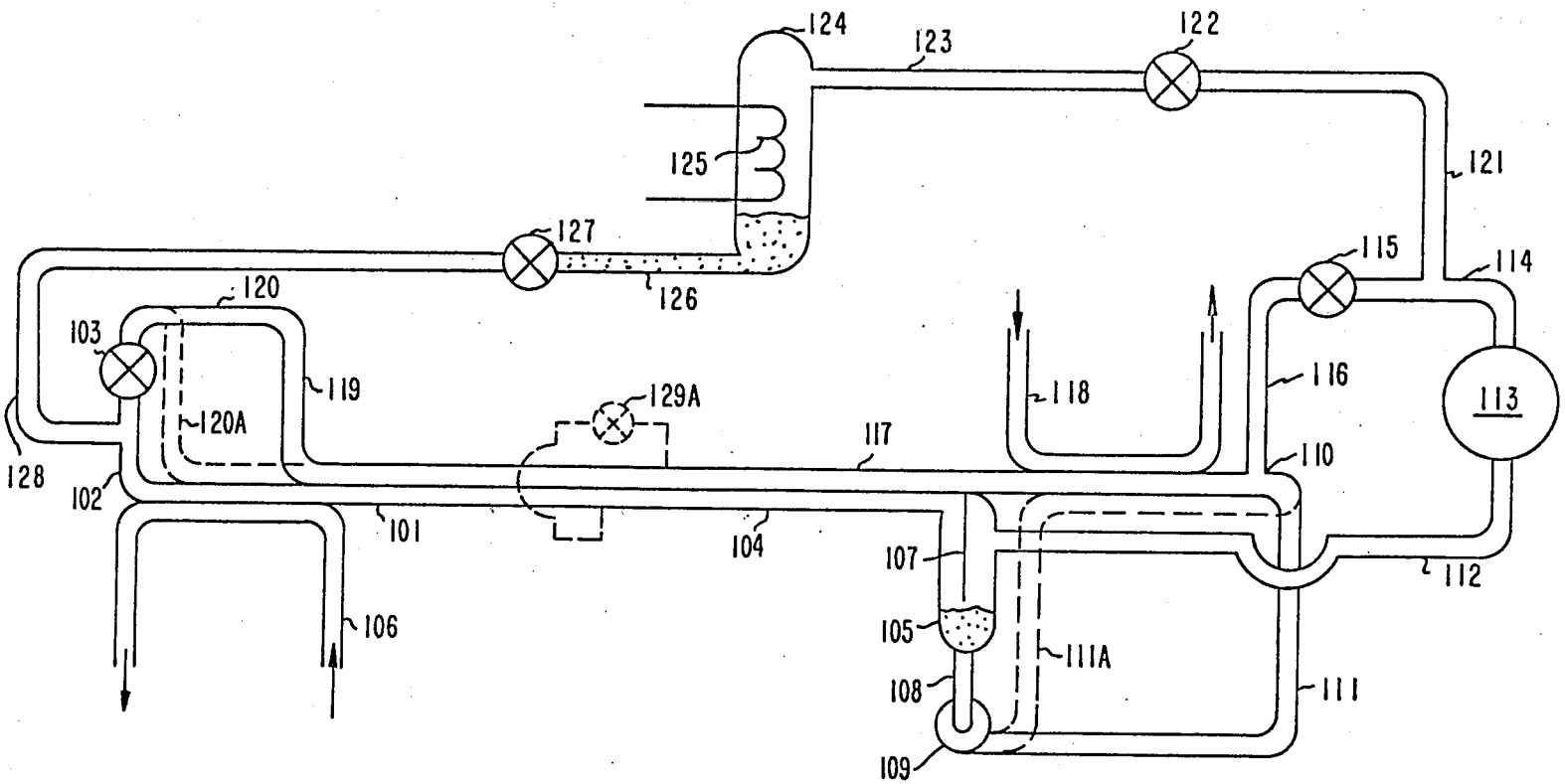
FIG. 5 is an illustration of a preferred embodiment of the present invention.

Turning now to FIG. 5, this figure illustrates the preferred embodiment of the present invention sized for a typical residential dwelling, e.g., a requirement of 3 tons of cooling capacity when operated in the cooling mode.

The desorber tube 101 is 20 meters long, has a diameter of ⅝ inch, and inlet 202 thereof is connected to an expansion valve 103. The outlet 104 of desorber tube 101 is connected to a separation chamber 105, which separates the liquid and vapor phases exiting the desorber tube 101. Close to the inlet 102 of desorber tube 101, a second tube 106 of ¾ inch diameter is welded to desorber tube 101 in parallel therewith, so that both are in good heat transfer contact. The tube 106 is welded to the desorber tube 101 over a length of about 5 meters.

The separation chamber 105 contains at least one baffle 107 to prevent liquid exiting the desorber tube 101 from being carried out of the separator chamber 105 with the vapor exiting the desorber tube 101. The bottom of the separation chamber 105 is connected via tube 108 to pump 109 which is further connected to the mixing "T" 110 by tube 111. Vapor is drawn from the separation chamber 105 through a tube 112 (¾ inch diameter) by the compressor 113 and then is fed through tube 114, valve 115 and tube 116 into the mixing "T" 110. The remaining connection of the mixing "T" 110 is connected to the absorber tube 117, another 20 meters long tube of ⅝ inch diameter, which is for most of its length welded to the desorber tube 101 for good thermal contract therebetween. The first portion of the absorber tube 117, over a length of about 5 meters, is welded to another tube 118 of ¾ inch diameter, in parallel therewith, so that both are in good heat transfer contact. The outlet 119 of the absorber tube 117 is connected via tube 120 to the expansion valve 103. In case of need, the vapor stream leaving the compressor 113 via tube 114 can be at least in part redirected through tube 121, valve 122, and tube 123 into the auxiliary condenser 124, which is cooled by the cooling coil 125. The liquid from auxiliary condenser 124 can be recirculated through tube 126, expansion valve 127 and tube 128 into inlet 102 of the desorber tube 101. All tubes have an outside diameter of ½ inch unless otherwise specified, with the wall thickness chosen to withstand anticipated pressure loads. The auxiliary condenser 124 has a volume of about 10 gallons and the separation chamber 105, which may also be a so-called accumulator which is a standard component in conventional heat pumps has a volume of about 2½ gallons. The compressor may be of any sort commonly employed in the air-conditioning industry. The heat exchangers may have the design as described or may be built of concentric tubes or may be coiled or otherwise brought into a more compact shape.

Additionally, tube 120 may be in a heat exchange relationship with desorber tube 101, indicated by dotted lines 120A, in the same area where tube 106 is welded to the desorber tube 101. Likewise tube 111 may be in a heat exchange relationship with absorber tube 117, indicated by dotted lines 111A, in the same area where tube 118 is welded to the absorber tube 117. These measures will increase the highest or lowest temperature achievable for the heat transfer fluids circulating in tubes 106 and 118 (indicated by arrows).

The preferred working fluid mixture is ammonia/water, but any other mixture of fluids with boiling points sufficiently far apart will be possible.

In the operation of the preferred embodiment, a liquid ammonia/water mixture, rich in ammonia, passes through tube 120, expansion valve 103 and inlet 102 into the desorber tube 101. Heat is added to this mixure in two parts. First, heat is added at a low temperature by the heat transfer fluid flowing through tube 106 (corresponding to the first fluid at temperature $T_1$), partially evaporating (desorbing) ammonia out of the liquid mxture. Second, heat is added from the absorber tube 117, at increasing temperatures, further evaporating (desorbing) ammonia. A mixture of ammonia vapor and a liquid ammonia/water mixture exits the desorber tube 101 into the separation chamber 105. Here the vapor is separated from the liquid phase and flows through tube 112 into the compressor 113. The vapor is compressed and then fed through the tube 114, valve 115 and pipe 116 into the mixing "T" 110. Simultaneously, the liquid remaining in the separation chamber 105 is pumped by pump 109 through tube 111 into the mixing "T" 110. In the mixing "T" 110 compressed vapor and liquid are merged and fed into the absorber tube 117. While the vapor is absorbed into the liquid phase, heat is liberated. This liberated heat is utilized in a two-fold manner. The first part is rejected at a high temperature to the heat transfer fluid flowing through tube 118 (corresponding to the second fluid at temperature $T_2$), thus, providing the heat output of the heat pump. The second part is rejected at decreasing temperatures to the desorber tube 101.

The pressure level in the desorber tube 101, and thus the capacity of the heat pump, can be controlled by the amount of ammonia present in the mixture. In order to remove ammonia from the mixture, valve 122 is opened and valve 115 closed. The vapor leaving the compressor 113, which is almost pure ammonia, is now condensed in the auxiliary condenser 124 and stored there because valve 127 remains closed. When sufficient ammonia is removed, valve 122 is closed and valve 115 is re-opened, with the cycle returning to its normal operating mode.

If ammonia is to be added to the cycle, valve 127 is opened and liquid ammonia flows into the desorber tube 101 mixing with the circulating mixture.

Of course, in order to adjust the composition of the circulating mixture, valves 122 and 115 may be controlled so that they are only partially opened or closed.

In a further alternative embodiment, at least one connecting pipe with an expansion valve therein, indicated by dotted lines 129A, may be used to connect desorber tube 101 and absorber tube 117. The flow through this connector being adjusted to better match the amount of heat release in the absorber 117 with the heat required in the desorber 101.

As will be appreciated, desorber tube 101 and absorber tube 117 need not be in direct physical contact for heat transfer therebetween but may be indirectly thermally coupled as by a heat transfer fluid circulating between them. Alternatively, the heat transfer between the absorber and desorber may be effected by heat pipes therebetween. Finally, while the preferred embodiment is shown with heat exchangers constructed from tubes, other heat exchanger constructions may be used, e.g., embodiments with enhanced heat transfer surfaces, compact heat exchangers and heat exchangers augmented by fins.

As will be appreciated by those skilled in the art, the present cycle may also be inverted to form a power cycle. In other words, by converting the compressor to a turbine, the expansion valves to pumps, the pump (if one is present) to an expansion valve and inverting the heat streams, a heat engine may be produced to drive a turbine and produce power.

Figure 6:
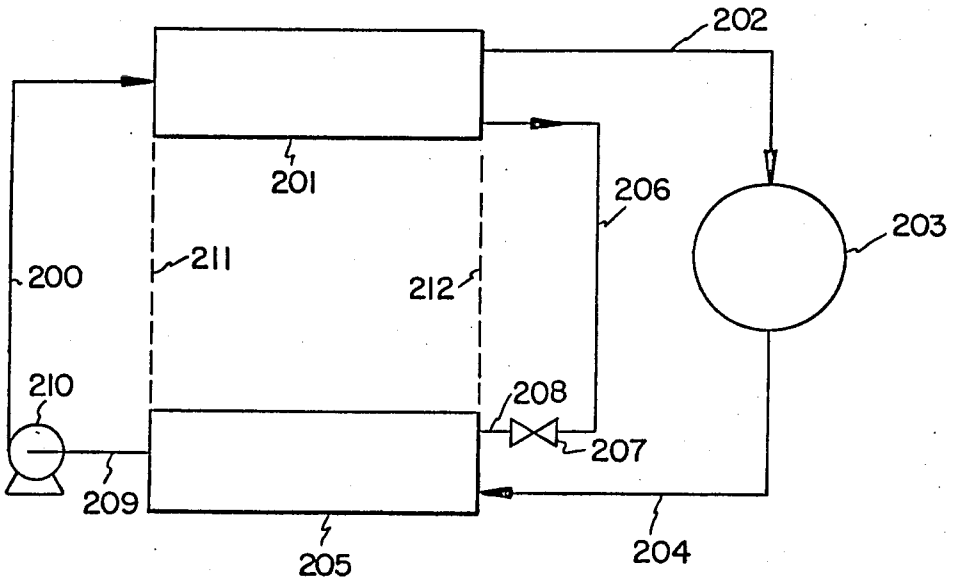
FIG. 6 is a schematic representation of a power cycle according to the present invention.

Referring to FIG. 6, a first liquid comprising a higher boiling component and a lower boiling component is fed into desorber 201 from tube 200. In the desorber 201, in a manner similar to the previously described heat pump cycle, the first liquid is heated, at least in part by contact with a high temperature fluid, so as to cause a portion of the lower boiling component to desorb thereby forming a first pressurized vapor rich in the lower boiling component and a pressurized second liquid rich in the higher boiling component. As previously described, the first pressurized vapor and the pressurized liquid are separated from one another, and the first pressurized vapor is fed to turbine 203 via tube 202. The first pressurized vapor drives turbine 203 and exits as a depressurized vapor via line 204 from whence it is fed into absorber 205. At the same time, the pressurized second liquid is passed via tube 206, expansion valve 207 and tube 208 into absorber 205. In the absorber, the depressurized vapor is absorbed into the depressurized second liquid, liberating heat, at least in part to a lower temperature fluid, to reform the first liquid which is removed from the absorber 205 via tube 209, pump 210 and thence into tube 200 to complete the cycle. As shown by dotted lines 211 and 212, the absorber 205 and the desorber 201 are thermally coupled in the same manner as the previously described heat pump cycles.

Finally, it is also possible to operate in the special case where all of the fluid in the desorber (evaporator) is vaporized and no liquid is left, thus the evaporation is complete. This allows omission of the liquid pump and its connecting tubing with a concomitant savings in the volume and weight of the system. However, since the working fluid mixture boils over a broad range, it is still possible to overlap the temperature ranges of the desorber (evaporator) and the absorber (condenser), and thereby obtain many of the advantages of the present invention, i.e. reduced pressure differentials for a given temperature differential, although with reduced versatility. This particular design, however, due to its lighter more compact structure, would find particular use in aircraft applications where the decreased weight and volume would be primary considerations.

What is claimed is:

1. A method of transferring heat from a first fluid having a temperature $T_1$ to a second fluid having a temperature $T_2$, when said temperature $T_2$ is greater than said temperature $T_1$, the method comprising:

providing a third fluid, comprising a mixture of a higher boiling component and a lower boiling component, having a temperature $T_A$, $T_A$ being less than $T_1$, said higher boiling component and said lower boiling component being miscible, said mixture releasing heat upon absorption of said lower boiling component therein and absorbing heat upon desorption of said lower boiling component therefrom;

adding heat to said third fluid to raise the temperature of the third fluid to a temperature $T_B$, $T_B$ being greater than $T_A$ and less than or substantially equal to $T_1$, whereby at least a portion of said lower boiling component desorbs from said third fluid to form a first liquid rich in said higher boiling component and a first vapor rich in said lower boiling component;

separating said first liquid from said first vapor;

compressing said first vapor to form a secondary pressurized vapor stream;

pumping said first liquid into contact with said secondary pressurized vapor stream to form a pressurized fourth fluid having a temperature $T_C$, $T_C$ being greater than $T_2$;

removing heat from said fourth fluid to lower the temperature of said fourth fluid to a temperature $T_D$, $T_D$ being less than $T_C$ and greater than or substantially equal to $T_2$, whereby said secondary pressurized vapor stream is absorbed to form in admixture with said first liquid, a presurized second liquid, said temperature $T_D$ being greater than $T_A$ and less than $T_B$, said temperature $T_B$ being greater than $T_D$ and less than $T_C$;

expanding said pressurized second liquid to form said third fluid;

wherein said addition of heat to said third fluid is effected by indirect thermal contact with said first fluid and indirect thermal contact with said fourth fluid; and said removal of heat from said fourth fluid is effected by indirect thermal contact with said second fluid and indirect thermal contact with said third fluid; and wherein, during the indirect thermal contact of said fourth fluid with said third fluid, a portion of said fourth fluid is depressurized and mixed with said third fluid.

2. The method according to claim 1, wherein the difference in boiling points between said higher boiling component and said lower boiling component is at least about 30° C.

3. The method according to claim 2, wherein the difference in boiling points between said higher boiling component and said lower boiling component is at least 50° C.

4. The method according to claim 3, wherein said higher boiling component is water and said lower boiling component is ammonia.

5. The method according to claim 1, wherein said addition of heat to said third fluid is effected sequentially by indirectly thermally contacting said third fluid with said first fluid to raise the temperature of said third fluid from said temperature $T_A$ to a temperature intermediate said temperatures $T_A$ and $T_B$; and then indirectly thermally contacting said third fluid with said fourth fluid to raise the temperature of said third fluid from said temperature intermediate said temperatures $T_A$ and $T_B$ to said temperature $T_B$.

6. The method according to claim 1, wherein said removal of heat from said fourth fluid is effected sequentially by indirectly thermally contacting said fourth fluid with said second fluid to lower the temperature of said fourth fluid from said temperature $T_C$ to a temperature intermediate said temperatures $T_C$ and $T_D$; and then indirectly thermally contacting said fourth fluid with said third fluid to lower the temperature of said fourth fluid from said temperature intermediate said temperatures $T_C$ and $T_D$ to said temperature $T_D$.

7. The method according to claim 1, wherein said addition of heat to said third fluid by indirect thermal contact with said fourth fluid is effected sequentially by indirectly thermally contacting said third fluid simultaneously with said first fluid and said fourth fluid to raise the temperature of said third fluid from said temperature $T_A$ to a temperature intermediate said temperatures $T_A$ and $T_B$; and then indirectly thermally contacting said third fluid with said fourth fluid to raise the temperature of said third fluid from said temperature intermediate said temperatures $T_A$ and $T_B$ to said temperature $T_B$.

8. the method according to claim 1, wherein said removal of heat from said fourth fluid by indirect thermal contact with said second fluid and indirect thermal contact with said third fluid is effected sequentially by indirectly thermally contacting said fourth fluid simultaneously with said second fluid and said third liquid to lower the temperature of said fourth fluid from said temperature $T_C$ to a temperature intermediate said temperatures $T_C$ and $T_D$; and then indirectly thermally contacting said fourth fluid with said third fluid to lower the temperature of said fourth fluid from said temperature intermediate said temperatures $T_C$ and $T_D$ to said temperature $T_D$.

9. The method according to claim 1, wherein said low boiling component is an inorganic material.

10. The method according to claim 9, wherein said inorganic material is selected from the group consisting of ammonia, carbon dioxide and sulfur dioxide.

11. The method according to claim 1, wherein said low boiling component is an organic material.

12. The method according to claim 11, wherein said organic material is selected from the group consisting of hydrocarbons, alcohols, amines and halocarbons.

13. The method according to claim 1, wherein said high boiling component is an inorganic material.

14. The method according to claim 13, wherein said inorganic material is selected from the group consisting of water, aqueous salt solutions and liquid ammonia salt solutions.

15. The method according to claim 1, wherein said high boiling component is an organic material.

16. The method according to claim 15, wherein said organic material is selected from the group consisting of hydrocarbons, alcohols, esters, ethers, amides and heterocyclics.

17. The method according to claim 1, wherein said high boiling component is selected from the group consisting of organophosphates, methyl amine salt solutions and alcoholic salt solutions.

18. A method of transferring heat from a first fluid having a temperature T to a second fluid having a temperature $T_2$, when said temperature $T_2$ is greater than said temperature $T_1$, the method comprising:

(a) providing a third fluid, comprising a mixture of a higher boiling component and a lower boiling component, having a temperature $T_A$, $T_A$ being less than $T_1$, said higher boiling component and said lower boiling component being miscible, said mixture releasing heat upon absorption of said lower boiling component therein and absorbing heat upon desorption of said lower boiling component therefrom;

(b) adding heat to said third fluid to raise the temperature of said third fluid to a temperature $T_B$, $T_B$ being greater than $T_A$ and less than or substantially equal to $T_1$, whereby at least a portion of said lower boiling component desorbs from said third fluid to form a first liquid rich in said higher boiling component and a first vapor rich in said lower boiling component;

(c) separating said first liquid from said first vapor;

(d) compressing said first vapor to form a first pressurized vapor;

(e) controllably separating said first pressurized vapor into a primary pressurized vapor stream and a secondary pressurized vapor stream;

(f) pumping said first liquid into contact with said secondary pressurized vapor stream to form a pressurized fourth fluid having a temperature $T_C$, $T_C$ being greater than $T_2$;

(g) removing heat from said fourth fluid to lower the temperature of said fourth fluid to a temperature $T_D$, $T_D$ being less than $T_C$ and greater than or substantially equal to $T_2$, whereby said secondary pressurized vapor stream is absorbed to form, in admixture with said first liquid, a pressurized second liquid;

(h) expanding said pressurized second liquid to form a fifth fluid;

(i) controlling the amount of said first pressurized vapor separated into said primary pressurized vapor stream and recycling a controlled depressurized portion thereof for admixture with said fifth fluid to form said third fluid so that said temperature $T_D$ is greater than $T_A$ and less than $T_B$ and said temperature $T_B$ is greater than $T_D$ and less than $T_C$;

wherein said addition of heat to said third fluid is effected by indirect thermal contact with said first fluid and indirect thermal contact with said fourth fluid; and said removal of heat from said fourth fluid is effected by indirect thermal contact with said second fluid and indirect thermal contact with said third fluid.

19. The method according to claim 18, wherein said step (i) comprises:

condensing said primary pressurized vapor stream to form a pressurized third liquid and storing said pressurized third liquid;

controllably expanding at least a portion of said pressurized third liquid to form a sixth fluid;

admixing said fifth and sixth fluids to form said third fluid;

controlling the amount of said first pressurized vapor separated into said primary pressurized vapor stream and controlling the amount of said third liquid expanded to form said sixth fluid so that said temperature $T_D$ is greater than $T_A$ and less than $T_B$ and said temperature $T_B$ is greater than $T_D$ and less than $T_C$.

20. An apparatus for transferring heat from a first fluid having a temperature $T_1$ to a second fluid having a temperature $T_2$, when said temperature $T_2$ is greater than said temperature $T_1$, said apparatus comprising a first heat exchanger means for indirectly thermally contacting a third fluid, comprising a high boiling component and a low boiling component, with said first fluid to raise the temperature of said third fluid from a temperature $T_A$ to a temperature intermediate said temperature $T_A$ and a temperature $T_B$, wherein $T_A$ is less than $T_B$ and $T_B$ is less than or substantially equal to $T_1$, whereby a first portion of said lower boiling component desorbs from said third fluid to form a first liquid rich in said higher boiling component and a first vapor rich in said lower boiling component;

separator means, connected to said first heat exchanger by first conduit means, for separating said first liquid from said first vapor;

compressor means, operably connected to said separator means, for compressing said first vapor to form a first pressurized vapor;

pumping means, operably connected to said separator means, for pumping said first liquid;

mixing means, operably connected to said compressor means and said pumping means, for mixing said first pressurized vapor and said first liquid to form a fourth fluid having a temperature $T_C$;

second heat exchanger means, operably connected to said mixing means, for indirectly thermally contacting said fourth fluid with said second fluid to lower the temperature of said fourth fluid to a temperature intermediate said temperature $T_C$ and a temperature $T_D$, wherein $T_C$ is greater than $T_D$ and $T_D$ is greater than or equal to $T_2$, whereby a first portion of said first pressurized vapor is absobed by said first liquid to form a pressurized second liquid;

expansion valve means, connected to second heat exchanger by second conduit means, for releasing pressure on said pressurized second liquid to form said third fluid;

said first conduit means and said second conduit means, in combination, cooperating to form a third heat exchanger means for indirectly thermally contacting said third fluid and said fourth fluid, whereby a further portion of said lower boiling component desorbs from said third fluid and the temperature of said third fluid is raised to $T_B$ and whereby a further portion of said first pressurized vapor is absorbed by said first liquid and the temperature of said fourth fluid is lowered to $T_D$;

pressure reducing connection means for connecting said first conduit means and said second conduit means for fluid flow of a portion of said fourth fluid from second conduit means to said first conduit means.

21. The apparatus according to claim 20, wherein said first heat exchanger means includes first auxiliary heat exchanger means for indirectly thermally contacting said fourth fluid with said third fluid while said third fluid indirectly thermally contacts said first fluid.

22. The apparatus according to claim 20, wherein said second heat exchanger means includes second auxiliary heat exchanger means for indirectly thermally contacting said first liquid with said fourth fluid while said fourth fluid indirectly thermally contacts said second fluid.

23. A method of transferring heat from a first fluid having a temperature $T_1$ to a second fluid having a temperature $T_2$, when said temperature $T_2$ is greater than said temperature $T_1$, the method comprising:

providing a third fluid, comprising a mixture of a higher boiling component and a lower boiling component, having a temperature $T_A$, $T_A$ being less than $T_1$, said higher boiling component and said lower boiling component being miscible, said mixture releasing heat upon absorption of said lower boiling component therein and absorbing heat upon desorption of said lower boiling component therefrom;

adding heat to said third fluid to raise the temperature of the third fluid to a temperature $T_B$, $T_B$ being greater than $T_A$ and less than or substantially equal to $T_1$, whereby said higher boiling component and said lower boiling component are both completely vaporized to form a first vapor;

compressing said first vapor to form a secondary pressurized vapor stream;

removing heat from said secondary pressurized vapor stream to lower the temperature of said secondary pressurized vapor stream to a temperature $T_D$, $T_D$ being less than $T_C$ and greater than or substantially equal to $T_2$, whereby said secondary pressurized vapor stream is totally condensed to form a pressurized second liquid, said temperature $T_D$ being greater than $T_A$ and less than $T_B$, said temperature $T_B$ being greater than $T_D$ and less than $T_C$;

expanding said pressurized second liquid to form said third fluid;

wherein said addition of heat to said third fluid is effected by indirect thermal contact with said first fluid and indirect thermal contact with said secondary pressurized vapor stream; and said removal of heat from said secondary pressurized vapor stream is effected by indirect thermal contact with said second fluid and indirect thermal contact with said third fluid.

24. The method according to claim 23, wherein said addition of heat to said third fluid is effected sequentially by indirectly thermally contacting said third fluid with said first fluid to raise the temperature of said third fluid from said temperature $T_A$ to a temperature intermediate said temperatures $T_A$ and $T_B$; and then indirectly thermally contacting said third fluid with said secondary pressurized vapor stream to raise the temperature of said third fluid from said temperature intermediate said temperature $T_A$ and $T_B$ to said temperature $T_B$.

25. The method according to claim 23, wherein said removal of heat from said secondary pressurized vapor stream is effected sequentially by indirectly thermally contacting said secondary pressurized vapor stream with said second fluid to lower the temperature of said secondary pressurized vapor stream from said temperature $T_C$ to a temperature intermediate said temperatures $T_C$ and $T_D$; and then indirectly thermally contacting said secondary pressurized vapor stream with said third fluid to lower the temperature of said secondary pressurized vapor stream from said temperature intermediate said temperatures $T_C$ and $T_D$ to said temperature $T_D$.

26. An apparatus for transferring heat from a first fluid having a temperature $T_1$ to a second fluid having a temperature $T_2$, when said temperature $T_2$ is greater than said temperature $T_1$, said apparatus comprising:

a first heat exchanger means for indirectly thermally contacting a third fluid, comprising a high boiling component and a low boiling component, with said first fluid to raise the temperature of said third fluid from a temperature $T_A$ to a temperature intermediate said temperature $T_A$ and a temperature $T_B$, wherein $T_A$ is less than $T_B$ and $T_B$ is less than or substantially equal to $T_1$, whereby a first portion of said lower boiling component desorbs from said third fluid to form a first liquid rich in said higher boiling component and a first vapor rich in said lower boiling component;

separator means, connected to said first heat exchanger by first conduit means, for separating said first liquid from said first vapor;

compressor means, operably connected to said separator means, for compressing said first vapor to form a first pressurized vapor;

pumping means, operably connected to said separator means, for pumping said first liquid;

mixing means, operably connected to said compressor means and said pumping means, for mixing said first pressurized vapor and said first liquid to form a fourth fluid having a temperature $T_C$;

second heat exchanger means, operably connected to said mixing means, for indirectly thermally contacting said fourth fluid with said second fluid to lower the temperature of said fourth fluid to temperature intermediate said temperature $T_C$ and a temperature $T_D$, wherein $T_C$ is greater than Tand $T_D$ is greater than or equal to $T_2$, whereby a first portion of said first pressurized vapor is absorbed by said first liquid to form a pressurized second liquid;

expansion valve means, connected to said second heat exchanger by second conduit means, for releasing pressure on said pressurized second liquid to form said third fluid;

said first conduit means and said second conduit means, in combination, cooperating to form a third heat exchanger means for indirectly thermally contacting said third fluid and said fourth fluid, whereby a further portion of said lower boiling component desorbs from said third fluid and the temperature of said third fluid is raised to $T_B$ and whereby a further portion of said first pressurized vapor is absorbed by said first liquid and the temperature of said fourth fluid is lowered to $T_D$;

vapor diversion means, intermediate said compressor means and said mixing means, for contrallably withdrawing a portion of said first pressurized vapor from said compressor means, condensing said first pressurized vapor, storing the so-formed condensate, controllably releasing the pressure on said condensate and mixing said depressurized condensate with said third fluid exiting said expansion valve means.

27. The apparatus according to claim 26 wherein said first heat exchanger means includes first auxiliary heat exchanger means for indirectly thermally contacting said fourth fluid with said third fluid while said third fluid indirectly thermally contacts said first fluid.

28. The apparatus according to claim 26, wherein said second heat exchanger means includes second auxiliary heat exchanger means for indirectly thermally contacting said first liquid with said fourth fluid while said fourth fluid indirectly thermally contacts said second fluid.

29. A method of generating power utilizing a first fluid having a temperature $T_1$ and a second fluid having a temperature $T_2$, said temperature $T_2$ being greater than said temperature $T_1$, the method comprising:

providing a third fluid, comprising a mixture of a higher boiling component and a lower boiling component, having a temperature $T_A$, $T_A$ being less than $T_2$, said higher boiling component and said lower boiling component being miscible, said mixture releasing heat upon absorption of said lower boiling component therein and absorbing heat upon desorption of said lower boiling component therefrom;

adding heat to said third fluid to raise the temperature of the third fluid to a temperature $T_B$, $T_B$ being greater than $T_A$ and less than or substantially equal to $T_2$, whereby said third fluid is vaporized to form a first pressurized vapor;

expanding said first pressurized vapor through a turbine to generate power thereby and produce a fourth fluid having a temperature $T_C$, $T_C$ being greater than $T_1$;

removing heat from said fourth fluid to lower the temperature of said fourth fluid to a temperature $T_D$, $T_D$ being less than $T_C$ and greater than or substantially equal to $T_1$, whereby said fourth fluid is cooled to form a depressurized third liquid, said tempeature $T_C$ being greater than $T_A$ and less than $T_B$, said temperature $T_A$ being greater than $T_D$ and less than $T_C$;

pumping said depressurized third liquid to form said third fluid;

wherein said addition of heat to said third fluid is effected by indirect thermal contact with said second fluid and indirect thermal contact with said fourth fluid; and said removal of heat from said fourth fluid is effected by indirect thermal contact with said first fluid and indirect thermal contact with said third fluid.

* * * * *